US008132891B2

(12) United States Patent
Hibi

(10) Patent No.: US 8,132,891 B2
(45) **Date of Patent: *Mar. 13, 2012**

(54) IMAGE RECORDING APPARATUS

(75) Inventor: Manabu Hibi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 396 days.

This patent is subject to a terminal disclaimer.

(21) Appl. No.: 12/403,373

(22) Filed: Mar. 12, 2009

(65) Prior Publication Data

US 2009/0244174 A1 Oct. 1, 2009

(30) Foreign Application Priority Data

Mar. 31, 2008 (JP) ..... 2008-090043

(51) Int. Cl.
*B41J 2/165* (2006.01)

(52) U.S. Cl. ..... 347/33

(58) Field of Classification Search ..... 347/20, 347/22, 23, 45, 47

See application file for complete search history.

(56) References Cited

U.S. PATENT DOCUMENTS

| | | | | |
|---|---|---|---|---|
| 6,270,191 | B1 * | 8/2001 | Morikoshi et al. | 347/44 |
| 7,517,048 | B2 * | 4/2009 | Takagi | 347/37 |
| 2004/0196326 | A1 | 10/2004 | Sasa | |
| 2005/0264603 | A1 | 12/2005 | Takagi | |
| 2006/0268050 | A1 | 11/2006 | Sonobe | |
| 2006/0274108 | A1 | 12/2006 | Shimizu | |
| 2007/0285461 | A1 | 12/2007 | Okada | |

FOREIGN PATENT DOCUMENTS

| | | | |
|---|---|---|---|
| JP | H10-258523 | A | 9/1998 |
| JP | 2004-058348 | A | 2/2004 |
| JP | 2004-262108 | A | 9/2004 |
| JP | 2005-335303 | A | 12/2005 |
| JP | 2006-289648 | A | 10/2006 |
| JP | 2006-327123 | A | 12/2006 |
| JP | 2007-331116 | A | 12/2007 |

OTHER PUBLICATIONS

Japan Patent Office; Notification of Reason for Refusal in Japanese Patent Application No. 2008-090043 (counterpart to the above-captioned U.S. patent application) mailed Apr. 6, 2010.

* cited by examiner

*Primary Examiner* — An Do
(74) *Attorney, Agent, or Firm* — Baker Botts L.L.P.

(57) ABSTRACT

An image recording apparatus including an ink-jet head having four ink supply passages, manifold passages communicating with the respective ink supply passages, and individual ink passages extending from the common passages to nozzles open in an ink ejecting surface, wherein groups of the nozzles communicating with the respective manifold passages are open in respective unit areas u1-u4 arranged on the ink ejecting surface. The apparatus further includes a wiping member which is moved by a moving mechanism to wipe the unit areas, an ink supply device for selectively supplying the ink supply passages with an ink to perform a purging action for discharging the ink from the nozzles, and a control device controlling the moving mechanism and the ink supply device such that before a wiping action of the wiping member in each unit area is initiated, the purging action in the following unit area as seen in a wiping direction has been initiated and such that the purging action in each unit area is completed immediately before the wiping action in that unit area is initiated.

8 Claims, 14 Drawing Sheets

IMAGE RECORDING APPARATUS

CROSS REFERENCE TO RELATED APPLICATION

The present application claims the priority from Japanese Patent Application No. 2008-090043 filed Mar. 31, 2008, the disclosure of which is herein incorporated by reference in its entirety.

BACKGROUND OF THE INVENTION

1. Field of the Invention

The present invention relates to an image recording apparatus for recording an image on a recording medium by ejecting droplets of a liquid.

2. Description of Related Art

An ink-jet head of an ink-jet printer has a common ink chamber communicating with a supply port through which an ink is supplied, and a plurality of individual ink passages which extend from outlet ports of the common ink chamber to respective nozzles open in an ink ejecting surface, through respective pressure chambers. A droplet of the ink is ejected from each nozzle when the ink in the corresponding pressure chamber is pressurized by a pulsation pressure wave. Air bubbles and foreign matters present in flow passages formed within the ink-jet head prevent normal propagation of the pulsation pressure wave applied to the ink in the pressure chambers, giving rise to a risk of deterioration of ink ejection characteristics of the ink-jet head. To overcome this drawback, there is known a technique of supplying the ink from the supply port to the nozzles, for the purpose of removing the air bubbles and foreign matters together with the ink ejected from the nozzles, and then wiping an ink ejecting surface of the ink-jet head with a wiping member, to remove the ink remaining on the ink ejecting surface. An example of this technique is disclosed in JP-2005-335303A.

According to the technique described above, the wiping member is moved in contact with the ink ejecting surface in the longitudinal direction of the ink ejecting surface, for wiping the ink ejecting surface. Generally, a negative pressure is generated within the nozzles due to a water head pressure, so that the ink which remains on the ink ejecting surface of the ink-jet head after the ink is ejected from the nozzles and until the wiping operation on the ink ejecting surface by the wiping member is performed tends to be sucked back into the nozzles as the time elapses. Consequently, the air bubbles and foreign matters once ejected together with the ink and remaining adjacent to the openings of the nozzles may be sucked back into the nozzles together with the ink. To prevent the once ejected air bubbles and foreign matters from being sucked back into the nozzles, a large volume of the ink must be ejected from the nozzles so that the ejected air bubbles and foreign matters are moved by a sufficient distance away from the openings of the nozzles, whereby the ink is considerably wasted for maintenance of the ink-jet head.

SUMMARY OF THE INVENTION

The present invention was made in view of the background art described above. It is therefore an object of the present invention to provide an image recording apparatus which has a liquid ejecting head and which permits significant reduction of a volume of a liquid required to be ejected for the purpose of removing air bubbles and foreign matters from the liquid ejecting head.

The object indicated above can be achieved according to a first aspect of this invention, which provides an image recording apparatus comprising: a liquid-droplet ejecting head which extends in one direction and which includes a plurality of incoming passages having respective inlets receiving a liquid, a plurality of common liquid passages communicating with the respective incoming passages, and a plurality of individual liquid passages extending from outlets of the common liquid passages to nozzles open in a liquid ejecting surface through pressure chambers; a liquid supply device configured to selectively supply the liquid to the plurality of incoming passages; a wiping member formed of an elastic material; a moving mechanism for moving the wiping member in the one direction, in contact with the liquid ejecting surface; and a control device configured to control the liquid supply device and the moving mechanism, and wherein the liquid ejecting surface has a plurality of unit areas which are arranged in the one direction such that a plurality of groups of the nozzles communicating with the respective incoming passages are open in the respective unit areas, the control device controlling the liquid supply device so as to sequentially supply the liquid to the incoming passages corresponding to the respective unit areas, in the order of arrangement of the unit areas in the above-indicated one direction, until a predetermined volume of the liquid is discharged from the nozzles in each of the unit areas, and controlling the moving mechanism such that the unit areas are sequentially wiped by the wiping member after the predetermined volume of the liquid is discharged from the nozzles in each of the unit areas.

In the image recording apparatus constructed according to the first aspect of the present invention, each unit area can be wiped by the wiping member immediately after the liquid is discharged from the nozzles in the unit area in question, making it possible to shorten a period of time from a moment at which a purging action to discharge the liquid from the nozzles in each unit area to a moment at which a wiping action of the wiping member in the unit area in question is initiated. Accordingly, a volume of the liquid once discharged from the nozzles and sucked back into the nozzles is reduced, so that the volume of the liquid required to be discharged to remove air bubbles and foreign matters together with the discharged liquid can be accordingly reduced.

The object indicated above can also be achieved according to a second aspect of this invention, which provides an image recording apparatus comprising: a liquid-droplet ejecting head which extends in one direction and which includes a plurality of nozzles and has a liquid ejecting surface in which the plurality of nozzles are open and which is divided into a plurality of unit areas such that at least one of the nozzles is open in each of the unit areas, the liquid-droplet ejecting head further including, for each of the plurality of unit areas, at least one incoming passage each having an inlet receiving a liquid, at least one common liquid passage communicating with the above-indicated at least one incoming passage, and at least one individual liquid passage each extending from an outlet of the corresponding common liquid passage to the above-indicated at least one of the nozzles open in the each unit area through a pressure chamber; liquid supply device configured to for selectively supply the liquid to the incoming passages corresponding to the unit areas; a wiping member formed of an elastic material; and a moving mechanism for moving the wiping member in the above-indicated one direction, in contact with the liquid ejecting surface, and wherein the plurality of unit areas are arranged in the above-indicated one direction, and are sequentially wiped by the wiping member, in the order of arrangement of the unit areas in the above-indicated one direction, the liquid supply device supplying the liquid to the incoming passages of the unit areas such that a purging action to discharge the liquid from the above-indicated at least one of the nozzles in each of the unit areas is completed immediately before a wiping action of the wiping member in each unit area is initiated.

In the image recording apparatus constructed according to the second aspect of the present invention, each unit area can be wiped by the wiping member immediately after the liquid is discharged from the nozzle or nozzles in the unit area in question, making it possible to shorten a period of time from a moment at which the purging action to discharge the liquid from the nozzles in each unit area to a moment at which a wiping action of the wiping member in the unit area in question is initiated. Accordingly, a volume of the liquid once discharged from the nozzles and sucked back into the nozzles is reduced, so that the volume of the liquid required to be discharged to remove air bubbles and foreign matters together with the discharged liquid can be accordingly reduced.

BRIEF DESCRIPTION OF THE DRAWINGS

The above and other objects, features, advantages and technical and industrial significance of the present invention will be better understood by reading the following detailed description of preferred embodiments of the present invention, when considered in connection with the accompanying drawings, in which.

DETAILED DESCRIPTION OF THE PREFERRED EMBODIMENT

The preferred embodiments of this invention will be described by reference to the drawings. <First Embodiment>

Figure 1:
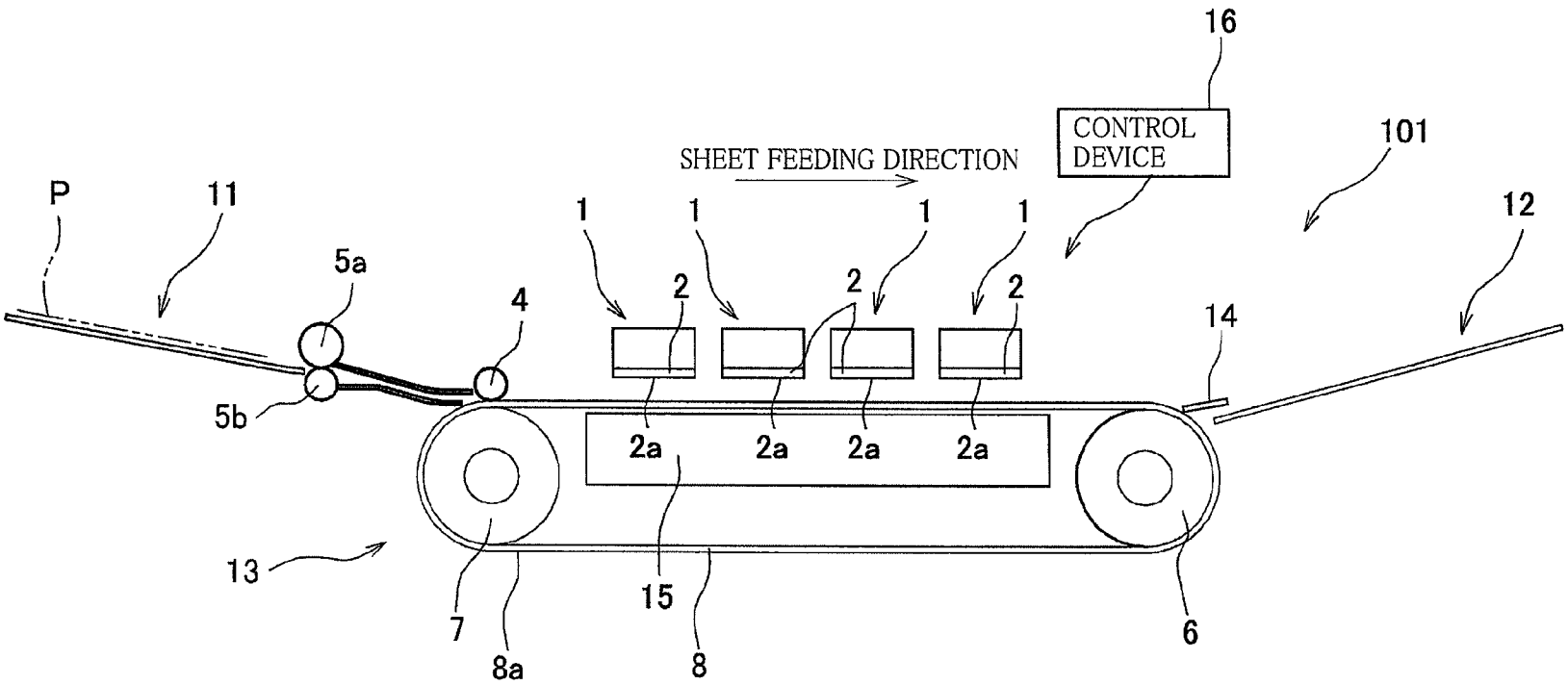
FIG. 1 is a schematic side elevational view of an ink-jet printer constructed according to a first embodiment of this invention.
Figure 2:
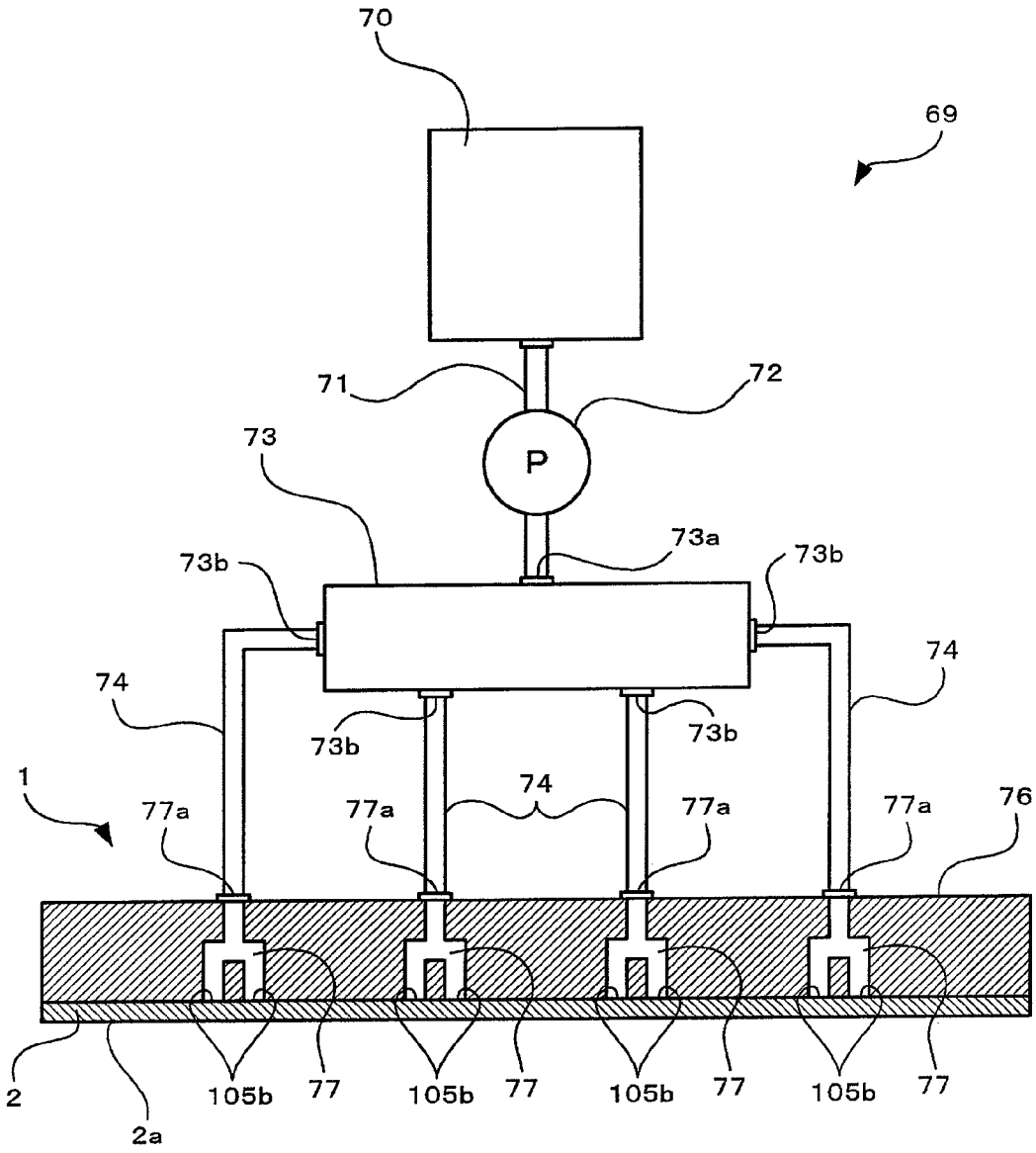
FIG. 2 is a schematic view of an ink supply mechanism to supply an ink to an ink-jet head of the ink-jet printer of FIG. 1.

Referring first to the schematic side elevational view of FIG. 1, there is shown an ink-jet printer 101 constructed according to the first embodiment of this invention, which has liquid-droplet ejecting heads in the form of four ink-jet heads 1 each provided with a liquid supply device in the form of an ink supply mechanism 69 shown in the schematic view of FIG. 2. The ink-jet printer 101 is a full-color printer, which includes a control device 16 for controlling an operation of the ink-jet printer 101 as a whole, a sheet supply portion 11 on a left-hand side of the ink-jet heads 1 as seen in FIG. 1, a sheet discharging portion 12 on a right-hand side of the ink-jet heads 1, and a maintenance unit 30 (shown in FIG. 6) on one of opposite sides of the ink-jet heads 1 as seen in a longitudinal direction of each ink-jet head 1, namely, as seen in a main scanning direction of the ink-jet printer 101. The maintenance unit 30 is not shown in FIG. 1, since the side elevational view of FIG. 1 is a view taken in a direction from the other of the above-indicated opposite sides toward the above-indicated one side.

As shown in FIG. 1, the ink-jet printer 101 has a sheet feeding path formed therethrough for feeding sheets P from the sheet supply portion 11 toward the sheet discharging portion 12. On the downstream side of the sheet supply portion 11, there is disposed a sheet supply roller pair 5*a*, 5*b* for supplying the sheets P one after another from the sheet supply portion 11 in the right direction as seen in FIG. 1, such that each sheet P is fed through a pressure nip of the two rollers 5*a*, 5*b*. At an intermediate portion of the sheet feeding path, there is disposed a sheet feeding mechanism 13, which includes two belt rollers 6, 7, an endless conveyor belt 8 connecting the two belt rollers 6, 7, and a platen 15 disposed within a space enclosed by the endless conveyor belt 8. The platen 15 is provided to support an upper span of the endless conveyor belt 8, at a position in opposition to the ink-jet heads 1, for preventing downward deflection of the above-indicated upper span. A nip roller 4 is disposed adjacent to the belt roller 7, for forcing the sheet P fed from the sheet supply portion 11, onto an outer circumferential surface 8*a* of the conveyor belt 8, in cooperation with the belt roller 7.

The belt roller 6 is driven by a sheet feeding motor (not shown), to rotate the conveyor belt 8 so that the sheet P forced by the nip roller 4 onto the outer circumferential surface 8*a* of the conveyor belt 8 is fed toward the sheet discharging portion 12, while being held adhering to the outer circumferential surface 8*a*, which is coated with a slightly tacky silicone resin layer.

On the downstream side of the conveyor belt 8, there is disposed a sheet separating plate 14 for separating the sheet P adhering to the outer circumferential surface 8*a* of the conveyor belt 8, from the outer circumferential surface 8*a*, for feeding the sheet P to the sheet discharging portion 12, which is disposed on the downstream side of the sheet separating plate 14.

The four ink-jet heads 1 correspond to respective four colors of inks (magenta, yellow, cyan and black inks), and are arranged in the sheet feeding direction while being supported by a head frame (not shown). Namely, the present ink-jet printer 101 is a line printer wherein the head frame is vertically movable together with the ink-jet heads 1, by a suitable elevator mechanism. As described below, the control device 16 controls the elevator mechanism such that the ink-jet heads 1 are located at a selected one of three positions, which are: an image recording position of FIGS. 1 and 8A; a standby position of FIG. 8B; and a wiping position of FIGS. 8C and 8D.

As shown in FIG. 2, each ink-jet head 1 has a reservoir unit 76, and a main body 2 fixed to the lower end of the reservoir unit 76. The reservoir unit 76 stores the ink supplied from the ink supply mechanism 69, and delivers the ink therefrom to the main body 22. The reservoir unit 76 has four incoming passages 77 formed therein. Each incoming passage 77 has an inlet 77*a* open in the upper surface of the reservoir unit 76, and two outlets open in the lower surface of the reservoir unit 76. Namely, the incoming passage 77 is bifurcated within the reservoir unit 76, so that the ink flows from the inlet 77*a* to the two outlets. These two outlets are held in communication with respective two inlet ports 105*b* open in the upper surface of the main body 2 (passage unit 9 which will be described). As is apparent from the following description, the two inlet ports 105*b* communicating with each incoming passage 77 correspond to a single manifold passage 105 of the passage unit 9 of the main body 2, as shown in FIG. 3.

The main body 2 of each ink-jet head 1 is a rectangular parallelepiped having a length in a direction perpendicular to the feeding direction of the sheet P, and the lower surface serving as a liquid ejecting surface in the form of an ink ejecting surface 2*a* which faces the outer circumferential surface 8*a* of the conveyor belt 8 and from which the ink is ejected toward the sheet P resting on the outer circumferential surface 8*a*. That is, the inks of the four different colors are ejected from the respective four ink-jet heads 1 placed at their image recording position, toward the upper surface (printing surface) of the sheet P while the sheet P is fed by the conveyor belt 8 under the main bodies 2, past the ink-jet heads 1 one after another, so that a desired color image can be formed on the sheet P.

Figure 3:
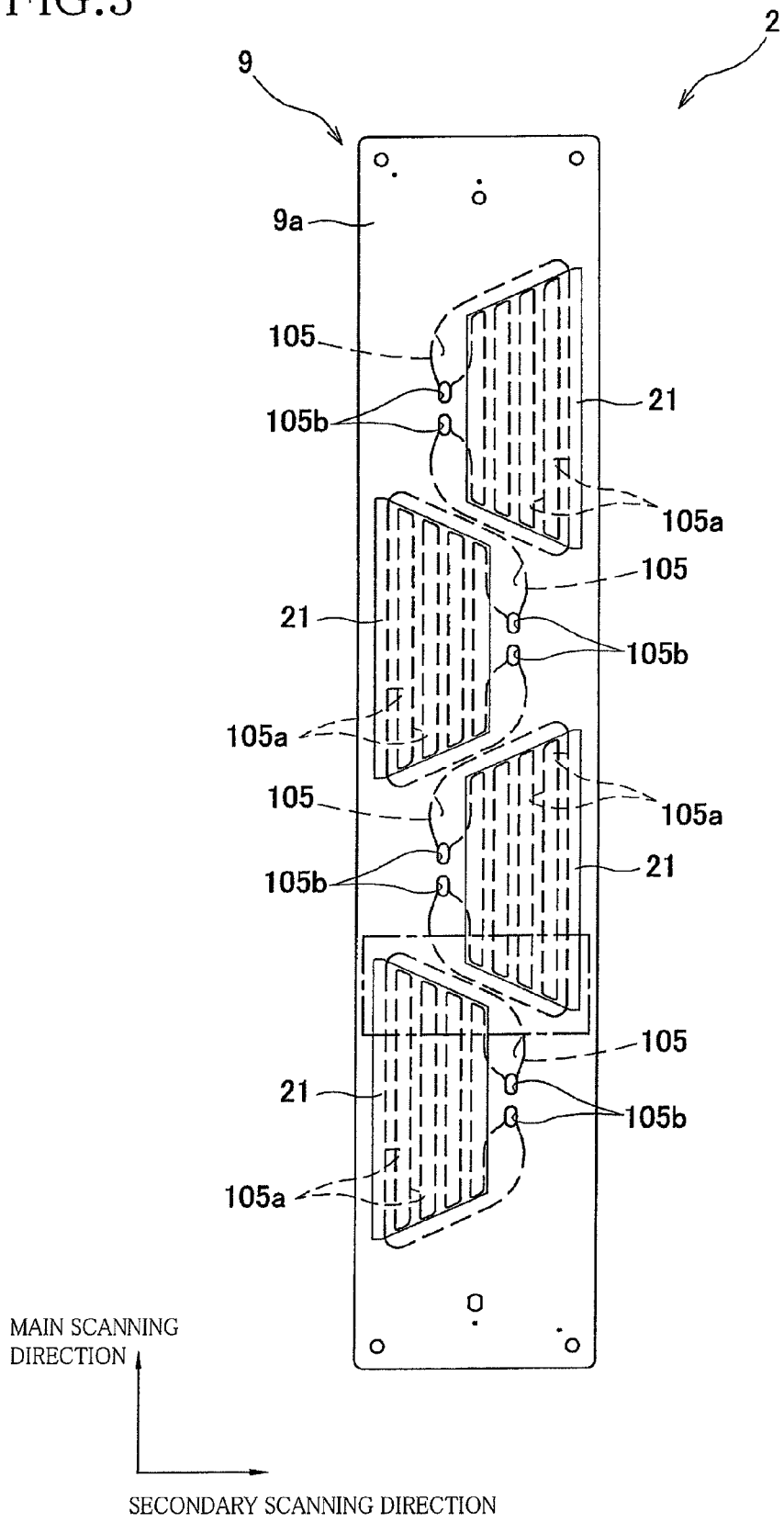
FIG. 3 is a plan view of a main body of the ink-jet head of the ink-jet head of FIG. 2.
Figure 4:
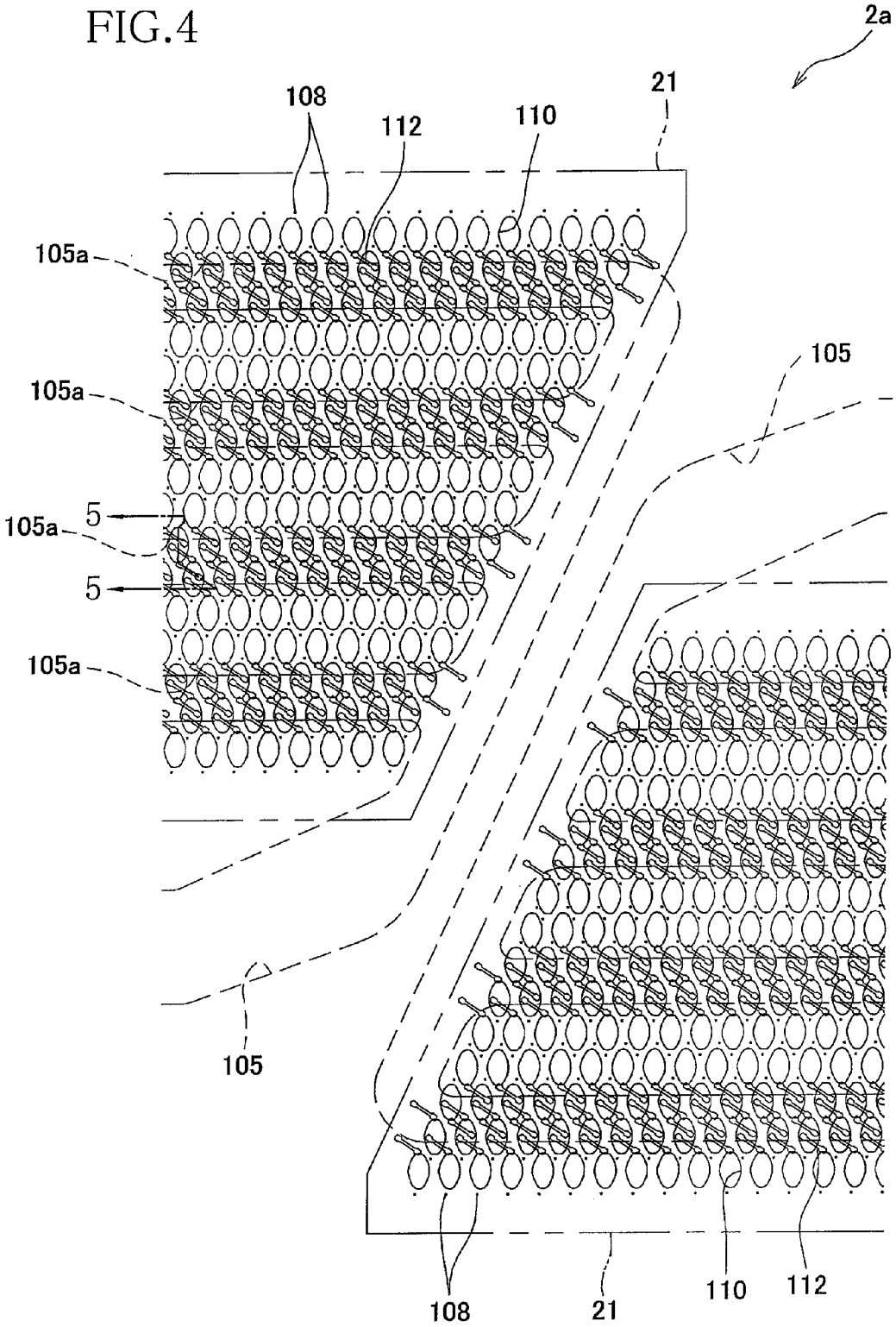
FIG. 4 is a view showing in enlargement an area enclosed by one-dot chain line in FIG. 3.
Figure 5:
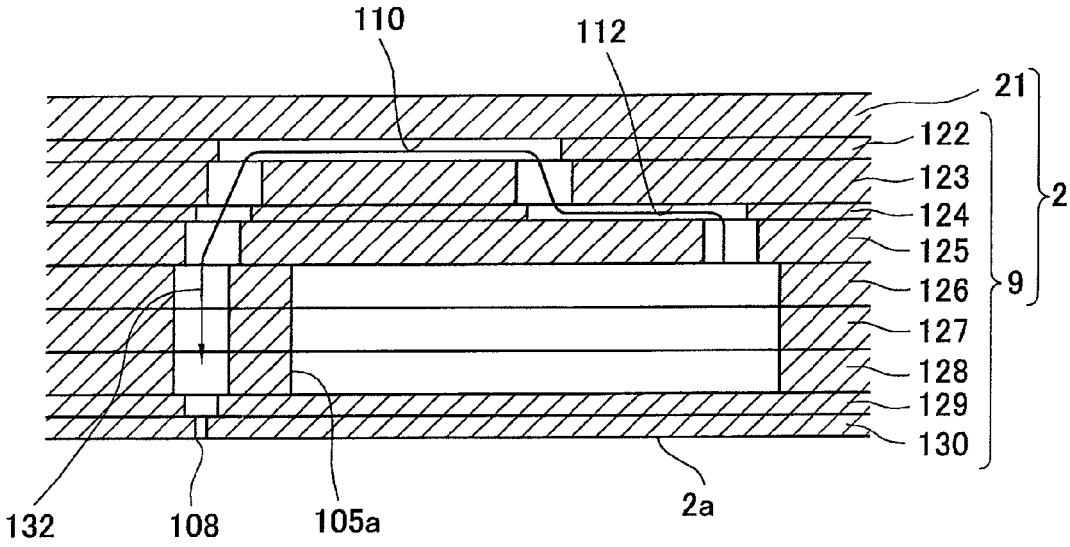
FIG. 5 is a cross sectional view taken along line 5-5 of FIG. 5.

Referring further to FIGS. 3-5, the main body 2 will be described in detail. FIG. 3 is a plan view of the main body 2, and FIG. 4 is a view showing in enlargement an area enclosed by one-dot chain line in FIG. 3, while FIG. 5 is a partial cross sectional view taken along line 5-5 of FIG. 5. In FIG. 4, pressure chambers 110, apertures 112 and nozzles 108 which are formed within actuator units 21 and which should be indicated by broken lines are indicated by solid lines.

As shown in FIG. 3, the main body 2 has the above-indicated passage unit 9 having an upper surface 9*a* on which the four actuator units 21 are fixed. As shown in FIG. 4, the passage unit 9 has a flow passage system formed therein, such that the flow passage system includes the pressure chambers 110, etc. Each actuator unit 21 includes a multiplicity of actuators which correspond to the respective pressure chambers 110 and which are driven by respective driver ICs (not shown) to apply an ejection energy to the ink within selected ones of the pressure chambers 110, for thereby ejecting the ink from the corresponding nozzles 108 through respective individual liquid passages in the form of individual ink passages 132 (shown in FIG. 5).

As shown in FIG. 3, the passage unit 9 is a rectangular parallelepiped having a length in the direction perpendicular to the feeding direction of the sheet P, that is, in the main scanning direction. The passage unit 9 has common liquid passages in the form of the four mutually independent manifold passages 105 which are disposed adjacent to the respective four actuator units 21, in a zigzag pattern, and arranged in the longitudinal direction (main scanning direction). Each manifold passage 105 has the two inlet ports 105*b* which are open in the upper surface 9*a* of the passage unit 9 and which are arranged in the main scanning direction. As previously described, these two inlet ports 105*b* are held in communication with the same incoming passage 77 (shown in FIG. 2) of the reservoir unit 76. Namely, the upper surface 9*a* of the passage unit 9 has a total of eight inlet ports 105*b* corresponding to the four incoming passages 77 such that the two inlet ports 105*b* are provided for each incoming passage 77. Each manifold passage 105 has a plurality of auxiliary manifold passages 105*a* extending in the main scanning direction in parallel with each other. The passage unit 9 has the lower surface in the form of the ink ejecting surface 2*a* having the multiplicity of nozzles 108 which are formed in a matrix. Like the nozzles 108, the pressure chambers 110 are formed in a matrix such that the pressure chambers 110 are partially defined by the lower surface of the actuator unit 21, as indicated in FIG. 5.

In the present embodiment, the pressure chambers 110 corresponding to each manifold passage 105 are arranged in a total of 16 rows which are equally spaced apart from each other in the transverse direction of the passage unit 9 and which extend in the longitudinal direction of the passage unit 9. The numbers of the pressure chambers 110 in the respective rows decrease in the direction in which the rows are spaced from the longer one of the opposite parallel sides of a trapezoid shape of the actuator unit 21 toward the other shorter parallel side.

As shown in FIG. 5, the passage unit 9 is a laminar structure consisting of nine plates 122-130 of a stainless steel or other metallic material. Each of these plates 122-130 has rectangular opposite major surfaces having a length in the main scanning direction.

The nine plates 122-130 have through holes formed therethrough, and are superposed on each other 132 such that the through holes communicate with each other so as to define the four manifold passages 105, auxiliary manifold passages 105*a* associated with the manifold passages 105 and communicating with the pressure chambers 110, and multiple individual flow passages 132 for communication of the pressure chambers 110 with the respective nozzles 108.

There will next be described a flow of the ink within the passage unit 9. The ink flows from each incoming passage 77 of the reservoir unit 69 into the manifold passages 105 and auxiliary manifold passages 105*a* of the passage unit 9 through the inlet ports 105*b*. The ink then flows from the auxiliary manifold passages 105*a* into the pressure chambers 110 through the above-indicated apertures 112 serving as flow restrictors, and then into the nozzles 108 through the individual ink passages 132.

Figure 9:
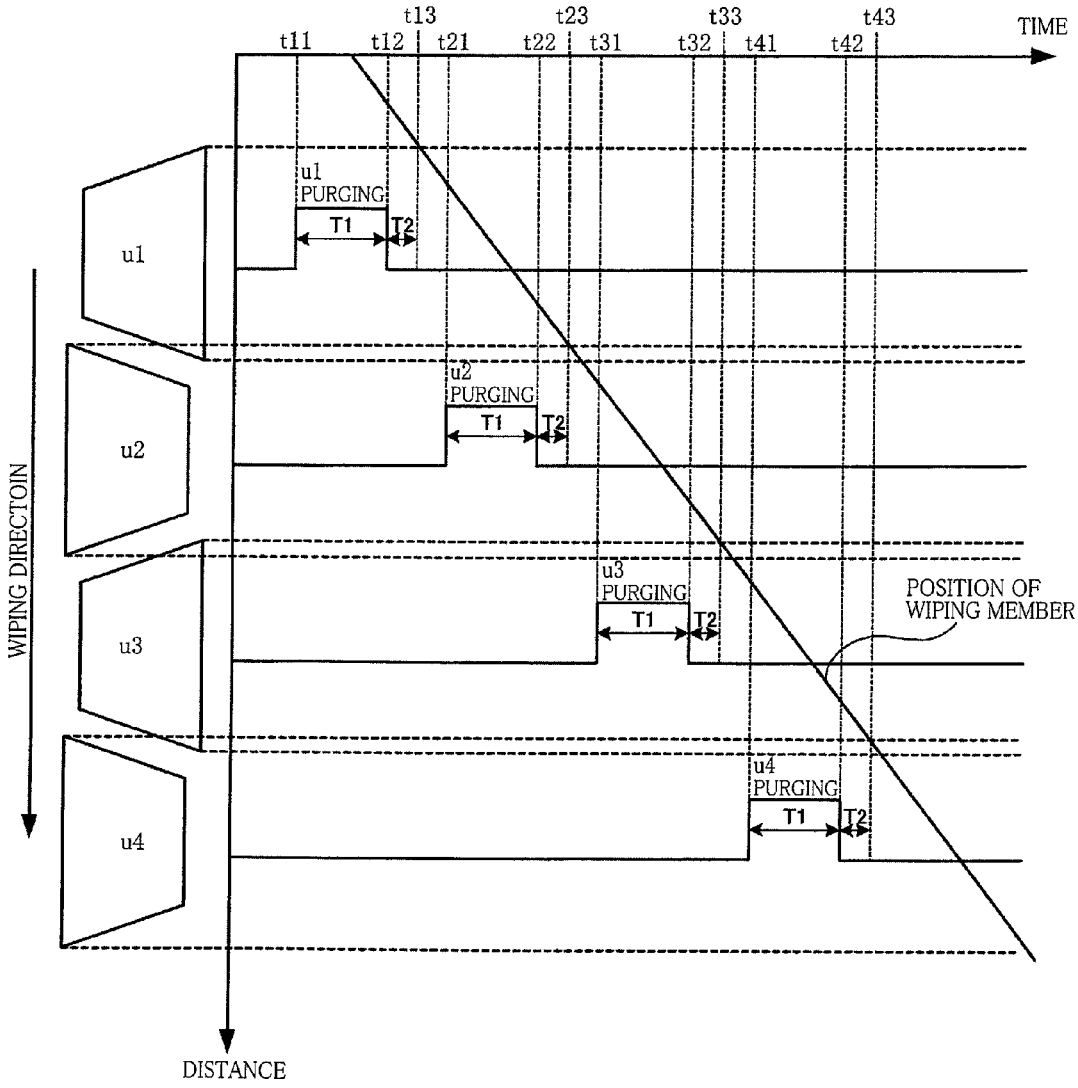
FIG. 9 is a time chart indicating a relationship between different positions of a wiping member of the maintenance unit and purging actions in respective unit areas of each ink-jet head.

As is apparent from the foregoing description, one passage unit is formed by the incoming passage 77 formed within the reservoir unit 76, the manifold passage 105 having the two inlet ports 105*b* in communication with the incoming passage 77, and the individual ink passages 132 in communication with the manifold passage 105. It will also be understood that each ink-jet head 1 has four mutually independent flow-passage units corresponding to the respective four incoming passages 77 and the respective four actuator units 21. The ink ejecting surface 2*a* of each ink-jet head 1 has four unit areas (four divisions) u1-u4 (indicated in FIG. 9) in which the nozzles 108 are distributed and which have a trapezoid shape similar to that of the actuator units 21. These four unit areas u1-u4 of the ink ejecting surface 2*a* are arranged in a zigzag pattern in the main scanning direction, as indicated in FIG. 9.

Referring back to FIG. 2, the ink supply mechanism 69 will be described. The ink supply mechanism 69 includes an ink tank 70, an ink supply pump 72, and a switch valve 73. The ink tank 70 and the switch valve 73 are connected to each other through a connecting pipe 71. The switch valve 73 is connected to the incoming passages 77 of the reservoir unit 76 through in liquid supply passages in the form of ink supply pipes 74. The ink tank 70 stores the ink of the color corresponding to the ink-jet head 1 in question. The connecting pipe 71 is provided with the ink supply pump 72, which is controlled by a purging control portion 84 (shown in FIG. 7)

of the control device 16, to deliver the ink from the ink tank 70 to the reservoir unit 76 through the switch valve 73.

The switch valve 73 has an inlet port 73*a* in communication with the ink tank 70 through the connecting pipe 71, and four outlet ports 73*b* in communication with the respective incoming passages 77 through the respective ink supply pipes 74. The switch valve 73 is controlled by the purging control portion 84 of the control device 16, for communication of the inlet port 73*a* with a selected one or all of the four outlet ports 73*b*. When the ink-jet printer 101 is operated to perform a normal image recording operation, the purging control portion84 holds the inlet port 73*a* with all of the four outlet ports 73*b*, and the ink supply pump 72 is held at rest while permitting a free flow of the ink from the ink tank 70 to the switch valve 73, so that the ink flows from the ink tank 70 to all of the incoming passages 77 of the reservoir unit 76. The ink supplied to each incoming passage 77 is supplied to the corresponding manifold passage 105 and to the individual ink passages 132. As the ink is consumed with ejection of the ink droplets from the nozzles 108 as a result of operation of the ink-jet head 1, a volume of the ink corresponding to the amount of consumption of the ink is supplied from the ink tank 70 to the ink-jet head 1.

The purging control portion 84 controls the switch valve 73 for communication with the inlet port 73*a* with the selected one of the four outlet ports 73*b*, during purging actions of the ink-jet head 1 wherein the ink droplets are ejected for the purpose of maintenance of the ink-jet head 1. During the purging actions, the ink is supplied from the ink tank 70 through the ink supply pump 72 to the flow-passage unit corresponding to the selected outlet port 73*b*, so that the ink is ejected from the nozzles 108 disposed in one of the four unit areas u1-u4, which corresponds to the flow-passage unit in question.

Figure 6:
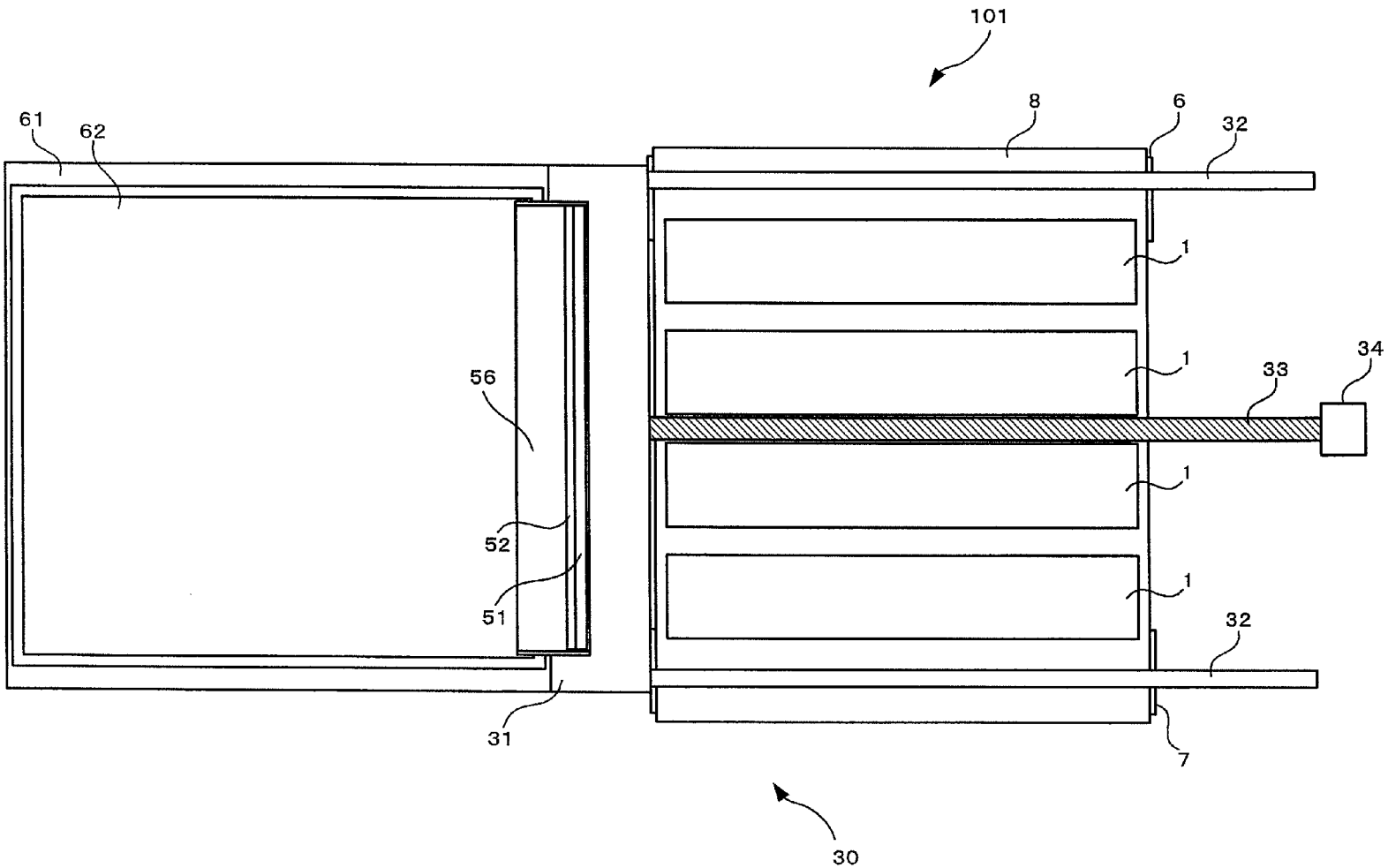
FIG. 6 is a schematic plan view of the ink-jet printer of FIG. 1.

Reference is now made to the schematic plan view of FIG. 6, which shows the maintenance unit 30 of the ink-jet printer 101. As shown in FIG. 6, the maintenance unit 30 functions to perform a maintenance operation of the ink-jet heads 1, and includes an X stage 31 movable in the main scanning direction, a wiping member 51, a holder 52, a discharging guide 56, and a movable tray 61 fixed to a left side surface of the X stage 31.

The X stage 31 extends in the secondary scanning direction in which the four ink-jet heads 1 are spaced from each other, as indicated in the plan view of FIG. 6. The X stage 31 is freely slidably supported by a pair of guide rails 32 which extend in the main scanning direction and which are fixed disposed at respective positions corresponding to the longitudinally opposite end portions of the X stage 31. A ballscrew 33 extending in parallel with the guide rails 32 is held in engagement with a nut fixed to the underside of the X stage 31. The ballscrew 33 is rotated by a maintenance motor 34 connected to its end remote from the end in engagement with the above-described nut. The X stage 31 is reciprocable in the main scanning direction when the maintenance motor 34 is operated to rotate the ballscrew 33. The maintenance motor 34 is controlled by a head position control portion 82 of the control device 16, for controlling the movement of the X stage 31 in the main scanning direction.

The wiping member 51, which is provided to wipe the ink ejecting surface 2*a* of each ink-jet head 1, is a rectangular plate member formed of a rubber, resin or any other elastic material. The wiping member 51 has a length sufficient to cover the four ink-jet heads 1 in the secondary scanning direction, and is supported by the holder 52 such that the wiping member 51 is inclined at a suitable angle with respect to the ink ejecting surfaces 2*a* of the ink-jet heads 1. The holder 52 is fixed to the upper surface of the X stage 31. The discharging guide 56 is fixed on the upper surface of the X stage 31, together with the holder 52, and has an inclined surface extending from the lower end of the wiping member 51 toward a waste ink tray 62 (as indicated in FIGS. 8A-8D).

As described above, the holder 52 supporting the wiping member 51 is fixed on the X stage 31, so that the wiping member 51 is moved in the main scanning direction when the X stage 31 is moved in the main scanning direction. As described below, the wiping member 51 is moved in the leftward direction as seen in FIG. 6, to wipe the ink ejecting surface 2*a* of each ink-jet head 1. This direction will be referred to as a wiping direction of the wiping member 51 or the ink-jet heads 1. It will be understood that the X stage 31, guide rails 32, ballscrew 33 and maintenance motor 34 cooperate to constitute a moving mechanism for moving the wiping member 51 in the main scanning direction, in contact with the ink ejecting surfaces 2*a* of the ink-jet heads 1.

The movable tray 61 is a rectangular plate member fixed to the left side surface of the X stage 31 as seen in FIG. 6, and is provided to support the waste ink tray 62. Accordingly, the waste ink tray 62 is moved together with the X stage in the main scanning direction. The waste ink tray 62 has a bottom surface large enough to cover the four ink-jet heads 1 when the waste ink tray 62 is placed in an ink-receiving position of FIG. 8C.

Figure 7:
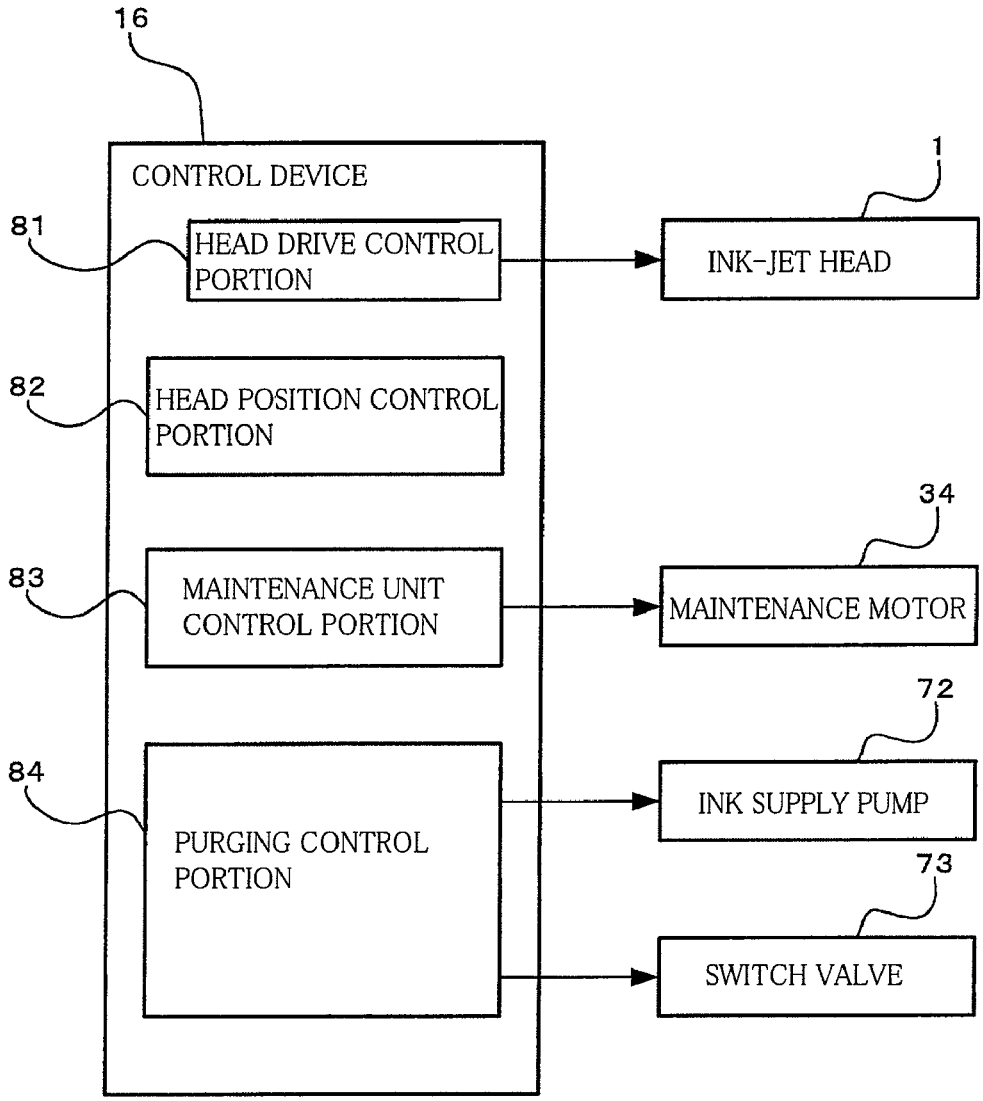
FIG. 7 is a functional block diagram of a control device shown in FIG. 1.

Referring further to the functional block diagram of FIG. 7, there will be described the functions of the control device 16. As shown in FIG. 7, the control device 16 includes a head drive control portion 81, the above-indicated head position control portion 82, a maintenance unit control portion 83, and the above-indicated purging control portion 84. The head drive control portion 81 is configured to drive the actuator unit 21 through the driver ICs, for controlling the operations of the ink-jet heads 1. The head position control portion 82 is configured to control the above-described elevator mechanism (not shown) for placing the four ink-jet heads 1 in one of the image recording position, standby position and wiping position described above. The maintenance unit control portion 83 is configured to control the maintenance motor 34 for controlling the movement of the X stage 31 in the main scanning direction. Namely, the maintenance unit control portion 83 controls the wiping operation of the wiping member 51 to wipe the ink ejecting surfaces 2*a*.

The purging control portion 84 is configured controls the ink supply pump 72 and the switch valve 73 during the purging actions in which the ink in the flow passages within the ink-jet heads 1 is discharged from the nozzles 108 for the purpose of maintenance of the ink-jet heads 1. Described in detail, the purging control portion 84 controls the switch valve 73 and the ink supply pump 72 to supply the ink to the incoming passages 77 corresponding to the respective unit areas u1-u4, one after another, in the order of the unit areas u1-u4 corresponding to the above-indicated wiping direction, so that a predetermined volume of the ink is discharged from each nozzle 108 in each of the unit areas u1-u4.

Referring next to FIGS. 8A-8D, there will be described an operation of the maintenance unit 30 for maintenance of the ink-jet heads 1. The side elevational views of FIGS. 8A, 8B, 8C and 8D show the positions of the maintenance unit 30 in respective steps implemented during a maintenance operation of the ink-jet heads 1 by the maintenance unit 30. The maintenance operation consists of the purging actions to discharge the ink from the flow-passage system in each ink-jet head 1, and the wiping actions to wipe off the ink remaining on the ink ejecting surfaces 2*a* of the ink-jet heads 1 after the purging actions. As a result of the purging actions, a mass of the ink having an increased degree of viscosity and impurities (air bubbles and foreign particles) are discharged from the nozzles 108. The wiping operation permits removal of the ink remaining on the ink ejecting surfaces 2*a* and the impurities, from the ink ejecting surfaces 2*a*. The maintenance operation of the ink-jet heads 1 is performed upon power application to the ink-jet printer 101, at a predetermined time interval after the power application, upon initiation of each image recording operation, or in response to a request by the user of the ink-jet printer 101 to perform the maintenance operation.

Figure 8A:
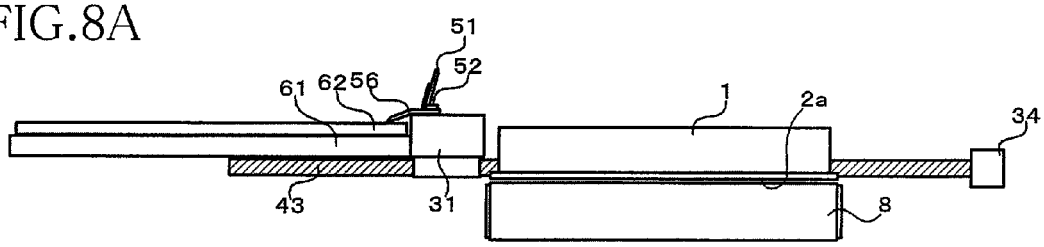
FIGS. 8A-8D are schematic side elevational views of a maintenance unit, showing steps of performing a maintenance operation of the ink-jet head of FIG. 2.

During a normal image recording operation, each ink-jet head 1 is placed in the image recording position of FIG. 8A in which there exists a predetermined gap between the ink ejecting surface 2*a* and the outer circumferential surface 8*a* of the conveyor belt 8. On the other hand, the waste ink tray 62 is placed in a retracted position (in the position of FIG. 6) in which the waste ink tray 62 is spaced from the four ink-let heads 1 in the main scanning direction, leftwards as seen in FIG. 8A.

Figure 8B:
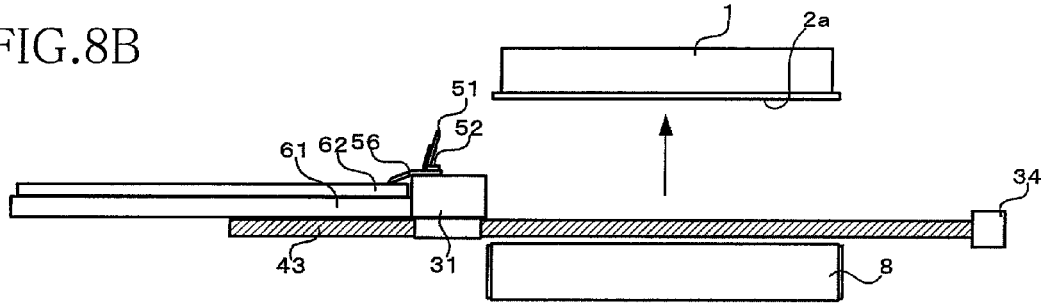

When the maintenance operation of the ink-jet heads 1 is initiated, the head position control portion 82 of the control device 16 controls the elevator mechanism (not shown) to raise the ink-jet heads 1 to the standby position of FIG. 8B in which the ink ejecting surfaces 2*a* are located above the upper end of the wiping member 51. Then, the maintenance unit control portion 83 of the control device 16 activates the maintenance motor 34 to move the X stage 31 in the right direction as seen in FIG. 8B, to the position of FIG. 8C for moving the waste ink tray 62 to the ink-receiving position in which the waste ink tray 62 is opposed to the ink ejecting surfaces 2*a* of the ink-jet heads 1. During this movement of the X stage 31, the ink-jet heads 1 are held in the standby position so that the upper end of the wiping member 51 does not contact the ink ejecting surfaces 2*a*.

Figure 8C:
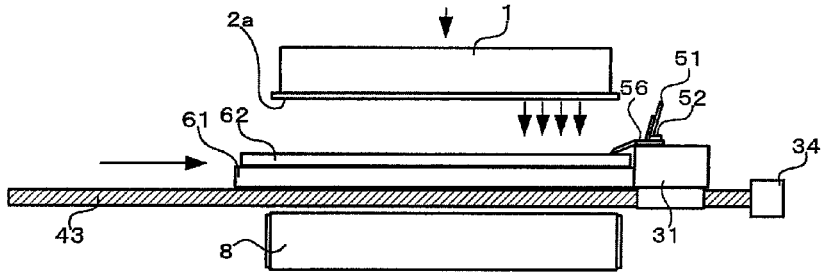

After the waste ink tray 62 has been moved to the ink-receiving position of FIG. 8C, the head control portion 82 of the control device 16 controls the elevator mechanism to lower the ink-jet heads 1 from the standby position of FIG. 8B to the purging position (wiping position) of FIG. 8C which is intermediate between the image recording position of FIG. 8A and the standby position of FIG. 8B. In the purging position of FIG. 8C, the ink ejecting surfaces 2*a* are located slightly below the upper end of the wiping member 51.

Then, the purging actions and the wiping actions of the ink-jet heads 1 are performed, as described below by reference to the time chart of FIG. 9. The time chart indicates a relationship between the different positions of the wiping member 51 and the purging actions in the unit areas u1-u4 of each ink-jet head 1.

In the purging position of the ink-jet heads 1, the purging control portion 84 of the control device 16 controls the switch valve 73 and the ink supply pump 72 to sequentially perform the purging actions in the unit areas u1-u4 one after another in this order of description, such that the ink is discharged from the nozzles 108 in each of the unit areas u1-u4, for a predetermined length of time T1, as indicated in the time chart of FIG. 9. Namely, the ink is initially discharged from the nozzles 108 in the unit area u1, then from the nozzles 108 in the unit area u2, then from the nozzles 108 in the unit area u3, and finally from the nozzles 108 in the unit area u4. The ink discharged from the nozzles 108 is received by the waste ink tray 62 in the ink-receiving position of FIG. 8C. The ink accommodated in the waste ink tray 62 is fed by a pump (not shown) to a suitable waste ink tank (not shown)

The maintenance unit control portion 83 controls the maintenance motor 34 to move the X stage 31 (wiping member 51) for initiating the wiping action of the wiping member 51 in each of the unit areas u1-u4 of each ink-jet head 1, immediately after the purging operation in each unit area u1, u2, u3, u4 is completed.

The purging control portion 84 controls the ink supply pump 72 such that a moment t12, t22, t32, t42 at which the purging action in each of the unit areas u1-u4 is completed is a predetermined length of time T2 prior to a moment t13, t23, t33, t43 at which the wiping member 51 reaches the upstream end of the unit area u1, u2, u3, u4 in question, that is, prior to the moment at which the wiping action of the wiping member 51 in the unit area u1, u2, u3, u4 in question is initiated. The predetermined length of time T2 is sufficiently shorter than the predetermined length of time T1. For instance, $0 \leqq T2 \leqq T1 \times 0.1$. In other words, the purging control portion 84 controls the ink supply pump 72 such that a moment t11, t21, t31, t41 of initiation of the purging action in each of the unit areas u1-u4 is T1+T2 prior to the moment t13, t23, t33, t43 of initiation of the wiping action in each unit area u1, u2, u3, u4.

Figure 8D:
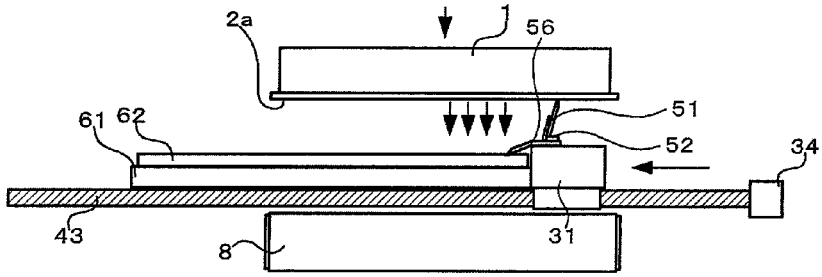

The maintenance unit control portion 83 controls the maintenance motor 34 to move the X stage 31 in the leftward direction as seen in FIG. 8D, with the upper end of the wiping member 51 held in contact with the ink ejecting surface 2*a* of each ink-jet head 1, such that the wiping member 51 is moved past the unit areas u1-u4 sequentially in this order of description. The wiping member 51 is brought into contact with the ink ejecting surface 2*a* at a position upstream of the position at which the wiping action in the first unit area u1 is initiated, so that the wiping member 51 is moved at a predetermined constant speed during the wiping actions in the unit areas u1-u4. As described above, the wiping action of the wiping member 51 in each unit area u1, u2, u3, u4 is initiated the predetermined length of time T2 after the purging action in each unit area u1, u2, u3, u4 is completed. Accordingly, the ink remaining in each unit area u1, u2, u3, u4 is removed by the wiping member 51 which sequentially wipes the unit areas u1-u4 in this order of description, in the downstream direction, that is, in the wiping direction indicated in FIG. 9, as indicated in FIGS. 8C and 8D. The ink removed by the wiping member 51 flows downwards along its inclined surface onto the discharging guide 56, and further flows downwards along the inclined surface of the discharging guide 56, finally falling into the waste ink tray 62. When the wiping member 51 has moved past the last unit area u4, the wiping actions in the unit areas u1-u4 are completed.

Described in greater detail by reference to the time chart of FIG. 9, the purging action in the unit area u1 is initiated at the point of time t11 and completed or terminated at the point of time t12, which is the predetermined length of time T1 after the point of time t11. In the present embodiment, the movement of the wiping member 51 is initiated during the purging action in the unit area u1. Then, at the point of time t13 which is the predetermined length of time T2 after the point of time t12, the wiping action in the unit area u1 is initiated. During the wiping action in the unit area u1, the purging operation in the unit area u2 is initiated at the point of time t21, and completed at the point of time t22, which is the predetermined length of time T1 after the point of time t21. Then, at the point of time t23 which is the predetermined length of time T2 after the point of time t22, the wiping action in the unit area u2 is initiated. Since the two adjacent unit areas u1 and u2 partially overlap each other, the wiping action in the unit area u1 is not yet completed at the moment t23 of initiation of the wiping action in the unit area u2.

Then, the wiping action of the wiping member 51 in the unit area u1 is completed, and the purging action in the unit area u3 is initiated at the point of time t31 during the wiping action in the unit area u2. The purging action in the unit area u3 is completed at the point of time t32 which is the predetermined length of time T1 after the point of time t31. At the point of time t33 which is the predetermined length of time T2 after the point of time t32, the wiping action in the unit area u3 is initiated. Then, the wiping action of the wiping member 51 in the unit area u2 is completed. In the same manner as described above, the purging action in the unit area u4 and the wiping actions in the unit areas u3 and u4 are completed. Thus, the purging and wiping actions in the four unit areas u1-u4 are performed.

As described above, the maintenance unit control portion 83 controls the maintenance motor 34 while the purging control portion 84 controls the ink supply pump 72 and the switch valve 73 such that the purging actions in the unit areas u2-u4 to discharge the ink from the nozzles 108 are initiated while the wiping actions of the wiping member 51 in the respective preceding unit areas u1-u3 as seen in the wiping direction are still being performed, and such that the purging actions in the unit areas u1-u4 are completed the predetermined short length of time T2 prior to the moment t13, t23, t33, t43 of initiation of the wiping actions in the unit areas u1-u4.

The predetermined length of time T1 for which the purging actions are performed represents a volume of the ink to be discharged during the purging actions. The ink remaining on the ink ejecting surface 2*a* after the purging action is sucked back into the nozzles 108 due to a negative pressure within the nozzles 108. Accordingly, the volume of the ink remaining on the ink ejecting surface 2*a* is determined by a period of time between the moment of initiation of the purging action in each unit area u1, u2, u3, u4 and the moment of initiation of the wiping action in the unit area in question. To prevent the air bubbles and impurities once discharged together with the ink during the purging action, from being sucked back into the nozzles 108 during the above-indicated period of time, the volume of the ink that must be discharged from the nozzles 108 during the purging action is a sum of a volume of the ink required to permit the air bubbles and impurities to be discharged together with the ink, and a volume of the ink required to prevent the suction of the air bubbles and impurities back into the nozzles 108. Accordingly, the length of time T1 is determined by the length of time during which each unit area u1, u2, u3, u4 is wiped by the wiping member 51, in other words, by the length of each unit area in the wiping direction.

After the wiping actions in the four unit areas u1-u4 are completed, the maintenance control portion 83 controls the maintenance motor 34 further moves the X stage 31 leftwards as seen in FIG. 8D, to move the waste ink tray 62 to the retracted position of FIG. 8A, while the head position control portion 82 controls the elevator mechanism to place the ink-jet heads 1 to the image recording position of FIG. 8A. Thus, the maintenance operation of the ink-jet printer 101 is completed. When the image recording operation is subsequently performed, the sheet p is fed. When the ink-jet printer 101 is turned off, the ink ejecting surfaces 2*a* of the ink-jet heads 1 are closed by respective caps (not shown).

In the present embodiment described above, the predetermined volume of the ink is discharged from the nozzles 108 in each of the unit areas u1-u4 immediately before the wiping action in the unit area in question is initiated. Accordingly, the wiping action in each unit area u1, u2, u3, u4 can be initiated immediately after the predetermined volume of the ink has been discharged from the nozzles 108 in the unit area in question. Thus, the length of time from the moment at which the ink has been discharged from the nozzles 108 to the moment at which the wiping action in each unit area is initiated is shortened. Accordingly, the volume of the ink discharged from the nozzles 108 is sucked back into the nozzles 108 can be reduced, so that the volume of the ink that must be discharged from the nozzles 108 during the purging actions can be reduced.

In addition, the ink supply mechanism 69 is simple in construction, including only the ink supply pump 72, and the switch valve 73 for selective communication of the inlet port 73*a* with one of the four outlet ports 73*b*.

Further, the ink-jet head 1 having the ink ejecting surface 2*a* provided by the single plate 130 can be small-sized. <Second Embodiment>

Figure 10:
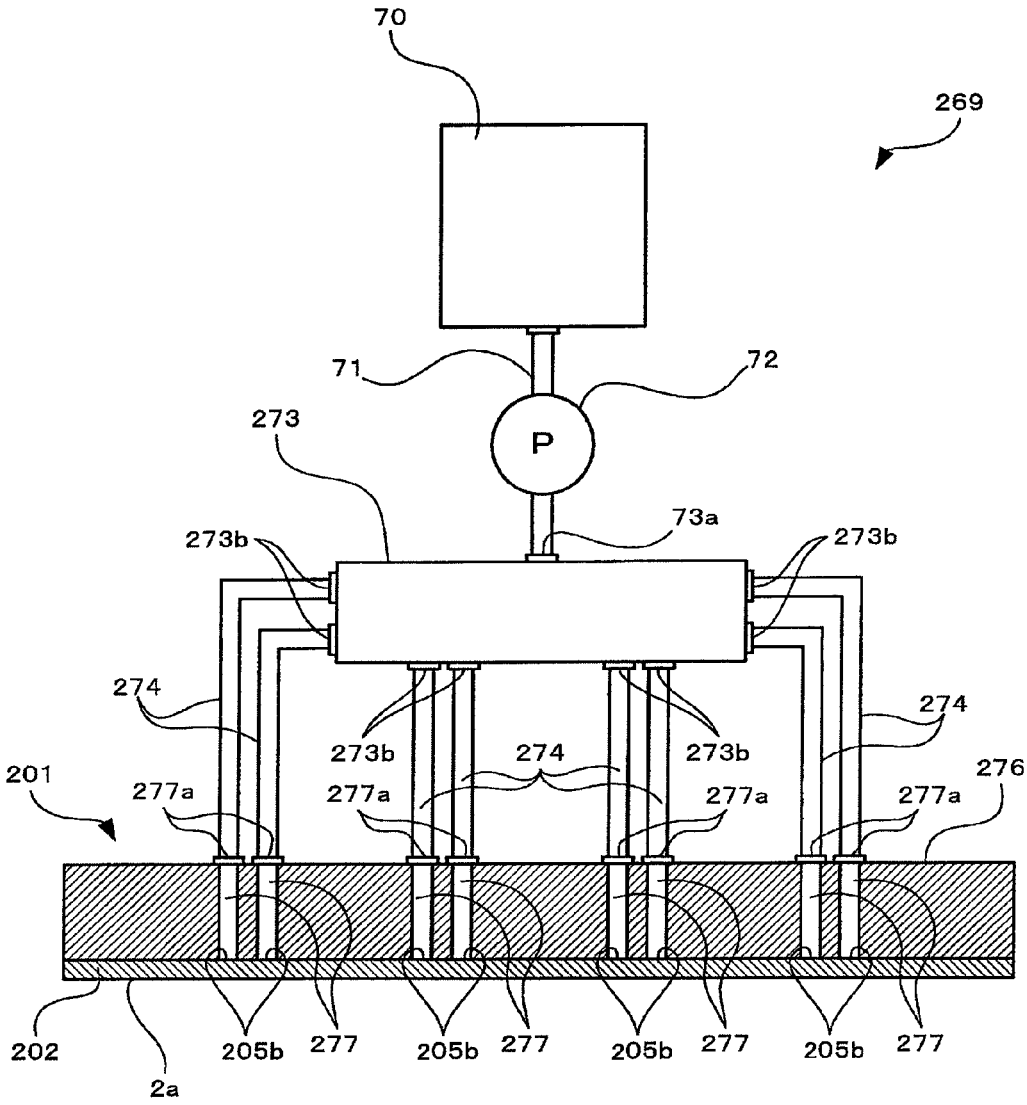
FIG. 10 is a schematic view of an ink supply mechanism according to a second embodiment of this invention.
Figure 11:
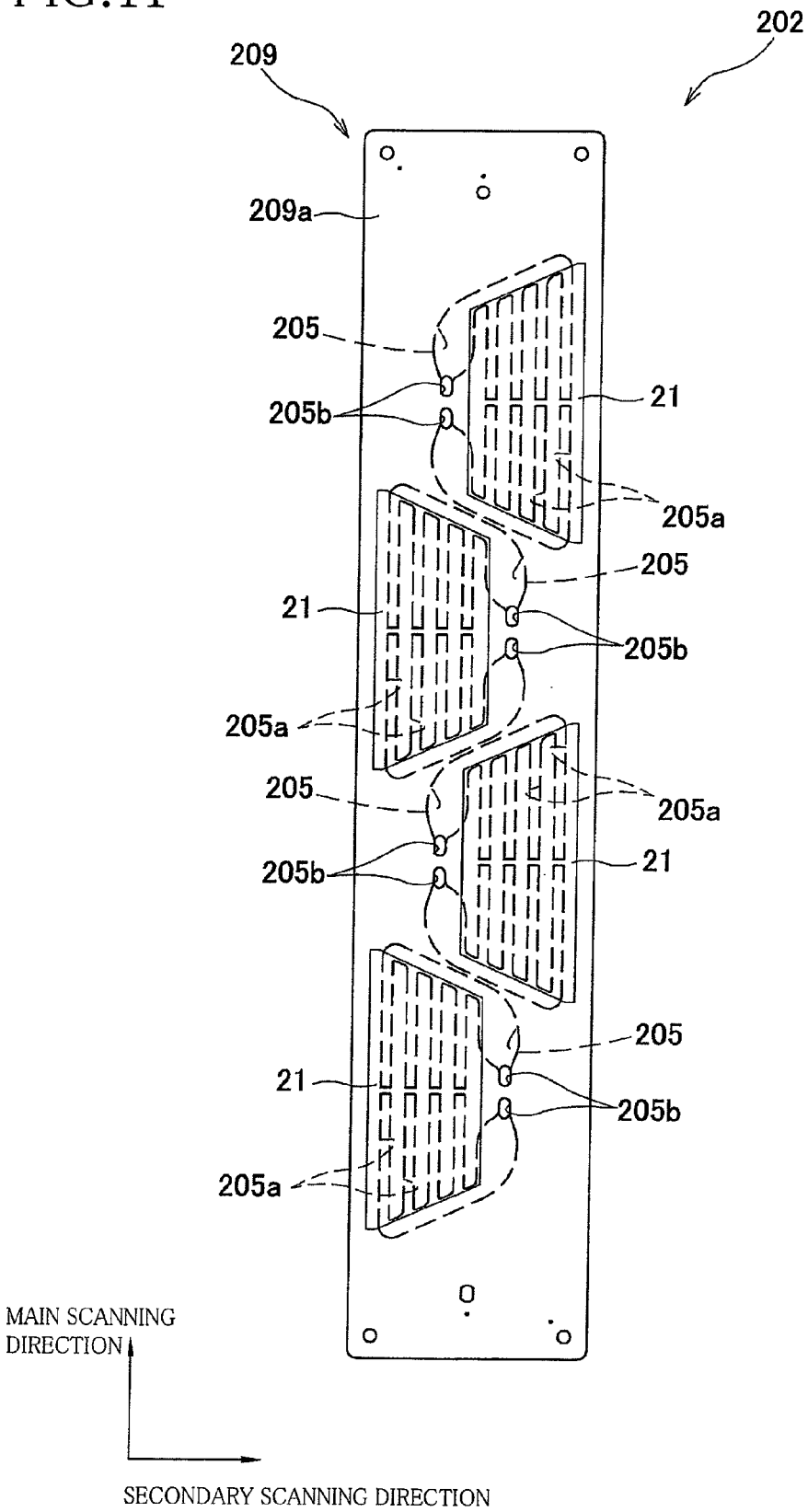
FIG. 11 is a plan view of a main body of the ink-jet head in the second embodiment.

Referring next to the schematic view of FIG. 10 and the plan view of FIG. 11, there will be described an ink-jet printer constructed according to the second embodiment of the present invention. The present ink-jet printer includes an ink supply mechanism 269 shown in FIG. 10, and four ink-jet heads 201 one of which is shown in FIG. 10 and a main body 202 of which is shown in FIG. 11. The same reference signs as used in the first embodiment will be used to identify the same elements in the second embodiment.

As shown in FIG. 10, each ink-jet head 201 has a reservoir unit 276 and a main body 202 fixed to the lower end of the reservoir unit 276. The reservoir unit 276 stores the ink supplied from the ink supply mechanism 269, and delivers the ink therefrom to the main body 202. The reservoir unit 276 has eight incoming passages 277 formed therein. Each incoming passage 277 has an inlet 277*a* open in the upper surface of the reservoir unit 276, and an outlet open in the lower surface of the reservoir unit 276, so that the ink flows from the inlet 277*a* to the outlet. This outlet is held in communication with an inlet port 205*b* open in the upper surface of the main body 202 (passage unit 209 which will be described).

As shown in FIG. 11, the passage unit 209 has eight mutually independent manifold passages 205, which are arranged in the longitudinal direction of the passage unit 209 (in the main scanning direction). Each of the manifold passages 205 has the above-indicated inlet port 205*b* open in an upper surface 209*a* of the passage unit 209. This inlet port 205*b* is held in communication with the corresponding one of the incoming passages 277 of the reservoir unit 276. Each manifold passage 205 has a plurality of auxiliary manifold passages 205*a* extending in the main scanning direction in parallel with each other.

Thus, one flow-passage unit is formed by the incoming passage 277 formed within the reservoir unit 276, the manifold passage 205 having the inlet port 205*b* in communication with the incoming passage 77, and the individual ink passages 132 in communication with the manifold passage 205. It will also be understood that each ink-jet head 201 has eight mutually independent flow-passage units corresponding to the respective eight incoming passages 277. The ink ejecting surface 2*a* of each ink-jet head 201 has eight unit areas (eight divisions) ua-uh (indicated in FIG. 12) in which the nozzles 108 are distributed. The eight unit areas ua-uh consist of four pairs of two adjacent unit areas, each pair corresponding to one of the four actuator units 21 each having a trapezoid shape. For instance, the two adjacent areas ua and ub correspond to the trapezoid shape of the actuator unit 21. Accordingly, the length of each of the unit areas ua-uh in the main scanning direction (wiping direction indicated in FIG. 12) is equal to a half of the length of each unit area u1, u2, u3, u4 in the first embodiment.

Referring back to FIG. 10, the ink supply mechanism 269 will be described. The ink supply mechanism 269 includes the ink tank 70, the ink supply pump 72, and a switch valve 273. The switch valve 273 has an inlet port 273*a* in communication with the ink tank 70 through the connecting pipe 71, and eight outlet ports 273*b* in communication with the respective incoming passages 277 through the respective ink supply pipes 274. The switch valve 273 is controlled by the purging control portion 84 of the control device 16, for communication of the inlet port 273*a* with a selected one of the eight outlet ports 273*b*, when the ink-jet printer 201 is operated to perform the maintenance operation. During the maintenance operation, the ink supply pump 72 is operated to deliver the ink from the ink tank 70 to the outlet port 273*b* of the switch valve 273 currently held in communication with the inlet port 273*a*.

The purging actions and wiping actions in the eight unit areas ua-uh in the second embodiment will be described by reference to the time chart of FIG. 12, which indicates the relationship between the different positions of the wiping member 51 and the purging actions in the unit areas ua-uh.

Figure 12:
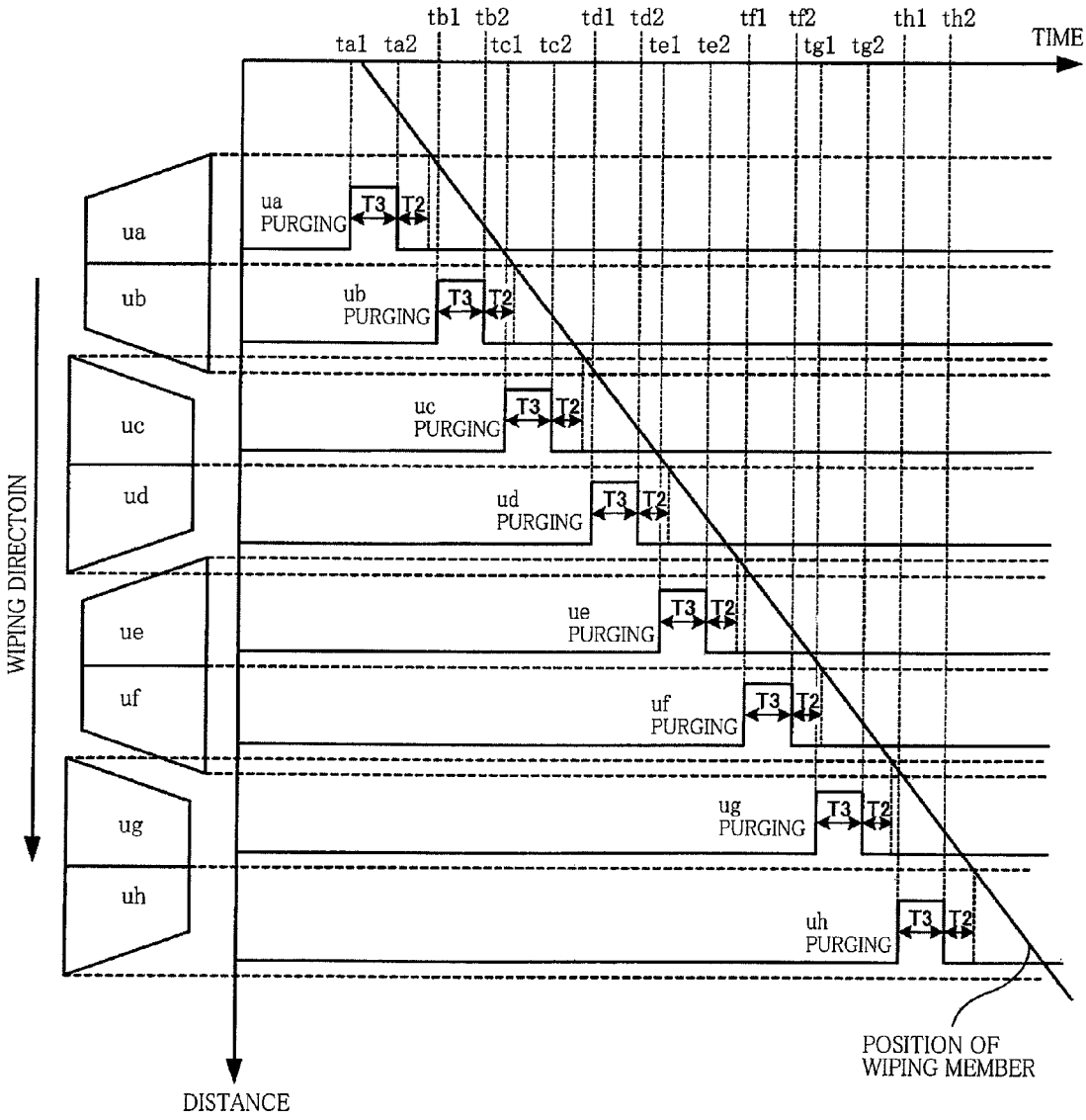
FIG. 12 is a time chart indicating a relationship between different positions of a wiping member of the maintenance unit and purging actions in respective unit area of the ink-jet head in the second embodiment.

When the ink-jet heads 201 are placed in the purging position, the purging control portion 84 of the control device 16 controls the switch valve 273 and the ink supply pump 72 such that the purging actions are sequentially performed in the unit areas ua-uh in this order of description, in the wiping direction indicated in FIG. 12, so that the ink is discharged from the nozzles 108 in each of the unit areas ua-uh, for a predetermined length of time T3. Initially, the purging action is performed in the first unit area ua, then in the unit area ub, then in the following areas uc-ug, and finally in the last unit area uh.

The purging control portion 84 controls the ink supply pump 72 such that a moment ta2, tb2, tc2, td2, te2, tf2, tg2, th2 at which the purging action in each of the unit areas ua-uh is completed is the predetermined length of time T2 prior to a moment at which the wiping member 51 reaches the upstream end of the unit area in question, that is, prior to the moment at which the wiping action of the wiping member 51 in the unit area u1-u4 in question is initiated. In other words, the purging control portion 84 controls the ink supply pump 72 such that a moment ta1, tb1, tb1, tc1, td1, te1, tf1, tg1, th1 of initiation of the purging action in each of the unit areas u1-u4 is T1+T2 prior to the moment of initiation of the wiping action in each of the unit areas ua-uh.

The maintenance unit control portion 83 controls the maintenance motor 34 to move the X stage 31, with the upper end of the wiping member 51 held in contact with the ink ejecting surface 2*a* of each ink-jet head 201, such that the wiping member 51 is moved past the unit areas ua-uh sequentially in this order of description. As described above, the wiping action of the wiping member 51 in each of the unit areas ua-uh is initiated the predetermined length of time T2 after the purging action in each unit area is completed (at the point of time ta2, tb2, . . . th2). Accordingly, the ink remaining in each of the unit areas ua-uh is removed by the wiping member 51 which sequentially wipes the unit areas ua-uh in this order of description, in the downstream direction, that is, in the wiping direction indicated in FIG. 12. As in the first embodiment, the wiping member 51 is brought into contact with the ink ejecting surfaces 2*a* at a position upstream of the first unit area ua as seen in the wiping direction, so that the wiping member 51 is moved at a predetermined constant speed during the wiping actions in the unit areas ua-uh.

As described above, the maintenance unit control portion 83 controls the maintenance motor 34 while the purging control portion 84 controls the ink supply pump 72 and the switch valve 273 such that the purging actions in the unit areas ub-uh to discharge the ink from the nozzles 108 are initiated while the wiping actions of the wiping member 51 in the respective preceding unit areas ua-ug as seen in the wiping direction are still being performed, and such that the purging actions in the unit areas ua-uh are completed the predetermined short length of time T2 prior to the moment of initiation of the wiping actions in the unit areas ua-uh.

In the present second embodiment described above, the predetermined volume of the ink is discharged from the nozzles 108 in each of the unit areas ua-uh immediately before the wiping action in the unit area in question is initiated. Accordingly, the length of time from the moment at which the ink has been discharged from the nozzles 108 to the moment at which the wiping action in each unit area is initiated is shortened, so that the volume of the ink discharged from the nozzles 108 is sucked back into the nozzles 108 can be reduced, and the volume of the ink that must be discharged from the nozzles 108 during the purging actions can be reduced.

In the present second embodiment, the length of each of the unit areas ua-uh is a half of the length of each unit area ua, u2, u3, u4 in the first embodiment, so that the length of time from the moment at which the purging action in each unit area is initiated to discharge the ink from the nozzles 108 to the moment at which the wiping action in each unit area is initiated is further shortened <Modified Arrangement>

Figure 13:
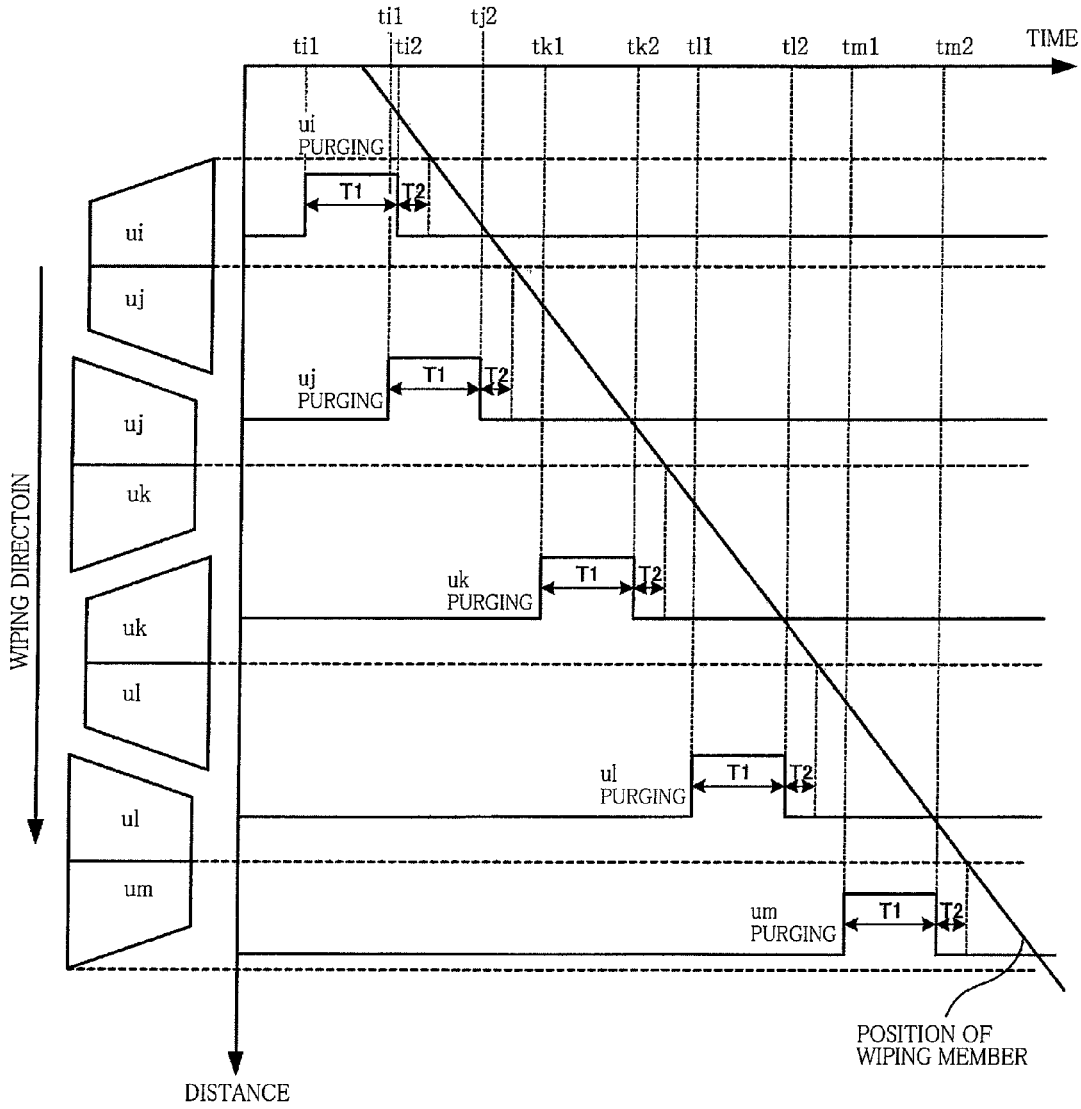
FIG. 13 is a view for explaining a modified embodiment of the invention.

In the first and second embodiments, the four flow-passage units correspond to the four manifold passages 105, while the eight flow-passage units correspond to the respective eight manifold passages 205. However, each flow-passage unit may correspond to one manifold passage 105, 205 or a plurality of manifold passages 105, 205. In a modified arrangement of FIG. 13, first and eighth manifold passages as seen in the wiping direction correspond to respective two flow-passage units corresponding to respective first and fifth unit areas ui and um, while three pairs of two adjacent manifold passages between the first and eight manifold passages correspond to respective three flow-passage units corresponding to respective second, third and fourth unit areas uj, uk and ul. The two adjacent manifold passages indicated above are connected to each other within the reservoir unit 276, so as to form one flow-passage unit. In this modification, each ink-jet head has a total of five unit areas ui-um.

The maintenance unit control portion 83 controls the maintenance motor 34 while the purging control portion 84 controls the ink supply pump 72 and the switch valve 73 such that the purging actions in the unit areas uj-um to discharge the ink from the nozzles 108 are initiated at points of time tj1, tk1, tl1, tm1 while the wiping actions of the wiping member 51 in the respective preceding unit areas ui-ul as seen in the wiping direction are still being performed, and such that the purging actions in the unit areas ui-um are completed at points of time ti2, tj2, tk2, tl2, tm2 the predetermined short length of time T2 prior to the moment of initiation of the wiping actions in the unit areas ui-um.

While the preferred embodiments of this invention have been described, it is to be understood that the present invention may be embodied with various changes and modifications, which may occur to those skilled in the art, without departing from the spirit and scope of the invention defined in the appended claims. In the illustrated embodiments, the purging actions in the unit areas to discharge the ink from then nozzles are initiated while the wiping actions of the wiping member 51 in the respective preceding unit areas as seen in the wiping direction are still being performed. However, the purging actions in the unit areas may be initiated before the wiping actions in the preceding unit areas as seen in the wiping direction are initiated.

Figure 14A:
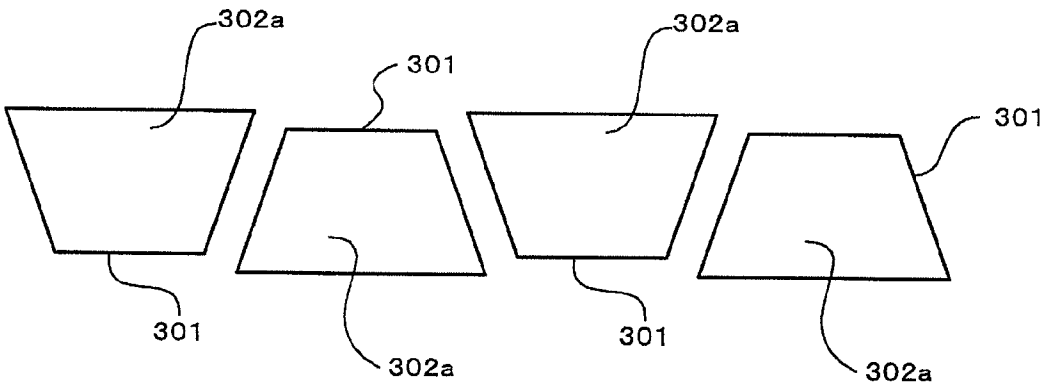
FIGS. 14A and 14B are views for explaining other modified embodiments of the invention.
Figure 14B:
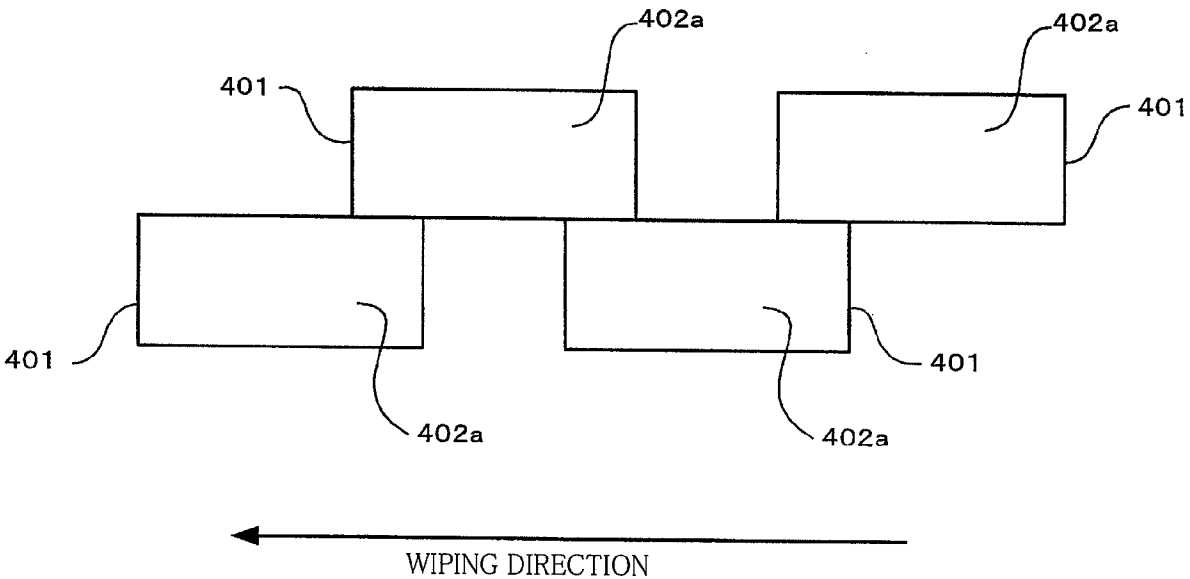

In the illustrated embodiments, each ink-jet head 1, 201 uses the single nozzle plate 130 having the ink ejecting surface 2*a*. However, each ink-jet head may consist of a plurality of divisions, for example, four divisions 301, which are arranged in a zigzag pattern, as shown in FIG. 14A. Each of the divisions 301 has an ink ejecting surface 302*a* having a trapezoid unit area. Alternatively, each ink-jet head consists of a plurality of divisions, for example, four divisions 401 each having an ink ejecting surface 402*a* having a rectangular unit area, as shown in FIG. 14B. In these cases, the divisions 301, 401 are easily assembled together into an ink-jet head having a relatively large length in the main scanning direction.

What is claimed is:

1. An image recording apparatus comprising:

a liquid-droplet ejecting head which extends in one direction and which includes a plurality of incoming passages having respective inlets receiving a liquid, a plurality of common liquid passages communicating with the respective incoming passages, and a plurality of individual liquid passages extending from outlets of the common liquid passages to nozzles open in a liquid ejecting surface through pressure chambers;

a liquid supply device configured to selectively supply the liquid to said plurality of incoming passages;

a wiping member formed of an elastic material;

a moving mechanism for moving the wiping member in said one direction, in contact with the liquid ejecting surface; and a control device configured to control said liquid supply device and said moving mechanism, and wherein said liquid ejecting surface has a plurality of unit areas which are arranged in said one direction such that a plurality of groups of said nozzles communicating with the respective incoming passages are open in the respective unit areas, said control device controlling said liquid supply device so as to sequentially supply the liquid to the incoming passages corresponding to the respective unit areas, in the order of arrangement of the unit areas in said one direction, until a predetermined volume of the liquid is discharged from the nozzles in each of said unit areas, and controlling said moving mechanism such that said unit areas are sequentially wiped by the wiping member after the predetermined volume of the liquid is discharged from the nozzles in each of the unit areas

2. The image recording apparatus according to claim 1, wherein said liquid supply device includes a plurality of liquid supply passages each having opposite ends one of which is connected to said inlet of a corresponding one of said incoming passages, a valve having a plurality of outlet ports each connected to the other of the opposite ends of a corresponding one of said liquid supply passages, and an inlet port, and a pump for supplying the liquid to said inlet port, and wherein said control device controls the valve for selective communication of said inlet port with one of said outlet ports.

3. The image recording apparatus according to claim 1, wherein said liquid-droplet ejecting head has a single plate having said liquid ejecting surface.

4. The image recording apparatus according to claim 1, wherein said liquid-droplet ejecting head consists of a plurality of divisions respectively having said plurality of incoming passages, said plurality of common liquid passages and said plurality of individual liquid passages, and wherein said plurality of divisions are arranged in a zigzag pattern in said one direction, and respectively have said plurality of unit areas.

5. The image recording apparatus according to claim 1, wherein said control device controls said liquid supply device and said moving mechanism such that a purging action to discharge said predetermined volume of the liquid from the nozzles in each of the unit area is completed immediately before a wiping action of the wiping member in said each unit area is initiated.

6. The image recording apparatus according to claim 1, wherein said plurality of unit areas consist of four unit areas in which four groups of the nozzles communicating with the respective four incoming passages are open.

7. The image recording apparatus according to claim 1, wherein said plurality of unit areas consist of eight unit areas in which eight groups of the nozzles communication with the respective eight incoming passages are open.

8. An image recording apparatus comprising:

a liquid-droplet ejecting head which extends in one direction and which includes a plurality of nozzles and has a liquid ejecting surface in which said plurality of nozzles are open and which is divided into a plurality of unit areas such that at least one of the nozzles is open in each of the unit areas, the liquid-droplet ejecting head further including, for each of the plurality of unit areas, at least one incoming passage each having an inlet receiving a liquid, at least one common liquid passage communicating with said at least one incoming passage, and at least one individual liquid passage each extending from an outlet of the corresponding common liquid passage to said at least one of the nozzles open in said each unit area through a pressure chamber;

a liquid supply device configured to selectively supply the liquid to the incoming passages corresponding to the unit areas;

a wiping member formed of an elastic material; and a moving mechanism for moving the wiping member in said one direction, in contact with the liquid ejecting surface, and wherein said plurality of unit areas are arranged in said one direction, and are sequentially wiped by said wiping member, in the order of arrangement of the unit areas in said one direction, said liquid supply device supplying the liquid to the incoming passages of the unit areas such that a purging action to discharge the liquid from the at least one of the nozzles in each of the unit areas is completed immediately before a wiping action of the wiping member in said each unit area is initiated.

* * * * *